US011459803B2

(12) United States Patent
Tametani

(10) Patent No.: US 11,459,803 B2
(45) Date of Patent: Oct. 4, 2022

(54) SIDE DOOR LATCH ASSEMBLY

(71) Applicant: Inteva Products, LLC, Troy, MI (US)

(72) Inventor: Yoshihiko Tametani, Kanagawa (JP)

(73) Assignee: INTEVA PRODUCTS, LLC, Troy, MI (US)

( * ) Notice: Subject to any disclaimer, the term of this patent is extended or adjusted under 35 U.S.C. 154(b) by 411 days.

(21) Appl. No.: 16/504,954

(22) Filed: Jul. 8, 2019

(65) Prior Publication Data

US 2020/0011095 A1 Jan. 9, 2020

Related U.S. Application Data

(60) Provisional application No. 62/695,438, filed on Jul. 9, 2018.

(51) Int. Cl.

| | |
|---|---|
| ***E05B 81/50*** | (2014.01) |
| ***E05B 77/26*** | (2014.01) |
| ***E05B 81/16*** | (2014.01) |
| ***E05B 81/36*** | (2014.01) |
| *E05B 79/08* | (2014.01) |
| *E05B 81/04* | (2014.01) |
| *E05B 83/36* | (2014.01) |

(52) U.S. Cl.

CPC ..... *E05B 81/50* (2013.01); *E05B 77/26* (2013.01); *E05B 81/16* (2013.01); *E05B 81/36* (2013.01); *E05B 79/08* (2013.01); *E05B 81/04* (2013.01); *E05B 83/36* (2013.01)

(58) Field of Classification Search

CPC ..... E05B 81/04; E05B 81/16; E05B 81/36; E05B 81/50; E05B 77/26; E05B 79/08; E05B 83/36; Y10T 292/307; Y10T 292/308; Y10T 292/1047; Y10T 292/1082; Y10S 292/23

See application file for complete search history.

(56) References Cited

U.S. PATENT DOCUMENTS

2016/0312499 A1* 10/2016 Fannon ..... E05B 81/20
2019/0360242 A1* 11/2019 Robertson ..... B60N 2/366

FOREIGN PATENT DOCUMENTS

| | | | | |
|---|---|---|---|---|
| CN | 106930623 A * | 7/2017 | | |
| DE | 202013105696 U1 * | 3/2015 | ..... | E05B 81/06 |
| DE | 102015116774 A1 * | 4/2017 | ..... | E05B 77/28 |
| EP | 0393595 B1 * | 3/1994 | ..... | E05B 81/20 |

OTHER PUBLICATIONS

Jul. 17, 2017 Machine translation of CN106930623A (Year: 2017).*

* cited by examiner

*Primary Examiner* — Christine M Mills
*Assistant Examiner* — Christopher F Callahan
(74) *Attorney, Agent, or Firm* — Cantor Colburn LLP

(57) ABSTRACT

A door latch assembly includes an actuator housing, a first post, a first sector gear, a first inner release lever, a first spring, a child link, and a first motor assembly. The actuator housing has a housing floor and a side wall extending therefrom. The first sector gear has a first head defining a first set of teeth and a first arm extending from the first head. The first spring has a first spring first arm and a first spring second arm. The child link is pivotally mounted for rotation about a second post of the first inner release lever. The first motor assembly is arranged to pivot the first sector gear about the first post, such that the child link pivots about the second post between a first child link position and a second child link position.

19 Claims, 4 Drawing Sheets

SIDE DOOR LATCH ASSEMBLY

CROSS REFERENCE TO RELATED APPLICATIONS

This application claims priority to U.S. Provisional Patent Application No. 62/695,438 filed on Jul. 9, 2018, the entire contents of which are incorporated herein by reference thereto.

BACKGROUND

The present disclosure relates to a door latch assembly that may be used in a vehicle.

Vehicle doors may be provided with a door latch assembly that may include a power child lock. During operation, should the spring forces within the door latch assembly not be balanced, the power child lock may cause the door latch assembly to jam. Furthermore, there is a push to provide a common door latch assembly that may be used on multiple vehicle platforms or may be used at various locations on a given vehicle platform.

Accordingly, it is desirable to provide a common door latch assembly that is resistant to jams.

SUMMARY

In at least one embodiment, a door latch assembly is provided. The door latch assembly includes an actuator housing, a first post, a first sector gear, a first inner release lever, a first spring, a child link, and a first motor assembly. The actuator housing has a housing floor and a side wall extending therefrom. The first post is disposed on the housing floor. The first sector gear is pivotally mounted for rotation about the first post. The first sector gear has a first head defining a first set of teeth and a first arm extending from the first head. The first inner release lever at least partially defines a second post. The first spring has a first spring first arm that is operatively connected to the side wall and a first spring second arm that is operatively connected to the first head. The child link is pivotally mounted for rotation about the second post. The child link has a first child link end connected to the first arm and a second child link end. The first motor assembly has a first drive member engaged with the first set of teeth. The first motor assembly is arranged to pivot the first sector gear about the first post between a first sector gear position and a second sector gear position, such that the child link pivots about the second post between a first child link position and a second child link position.

In at least one embodiment, a door latch assembly is provided. The door latch assembly includes an actuator housing, a first sector gear, a child link, and an inner release spring. The actuator housing has a housing floor and a side wall extending from the housing floor. The housing floor defines a guide and the side wall defines a mounting feature. A first post and a third post are disposed on the housing floor. The first sector gear is pivotally mounted for rotation about the first post. The first sector gear has a first head defining a first set of teeth and a first arm having a distal end that defines a guide surface that selectively engages the guide. The child link is pivotally mounted for rotation about a second post defined by a first inner release lever. The child link has a first child link end and a second child link end. The inner release spring is disposed about the third post and has an arm that engages the first head.

These and other advantages and features will become more apparent from the following description taken in conjunction with the drawings.

BRIEF DESCRIPTION OF THE DRAWINGS

The subject matter of the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Referring now to the Figures, where the present disclosure will be described with reference to specific embodiments, without limiting the same, it is to be understood that the disclosed embodiments are merely illustrative of the present disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
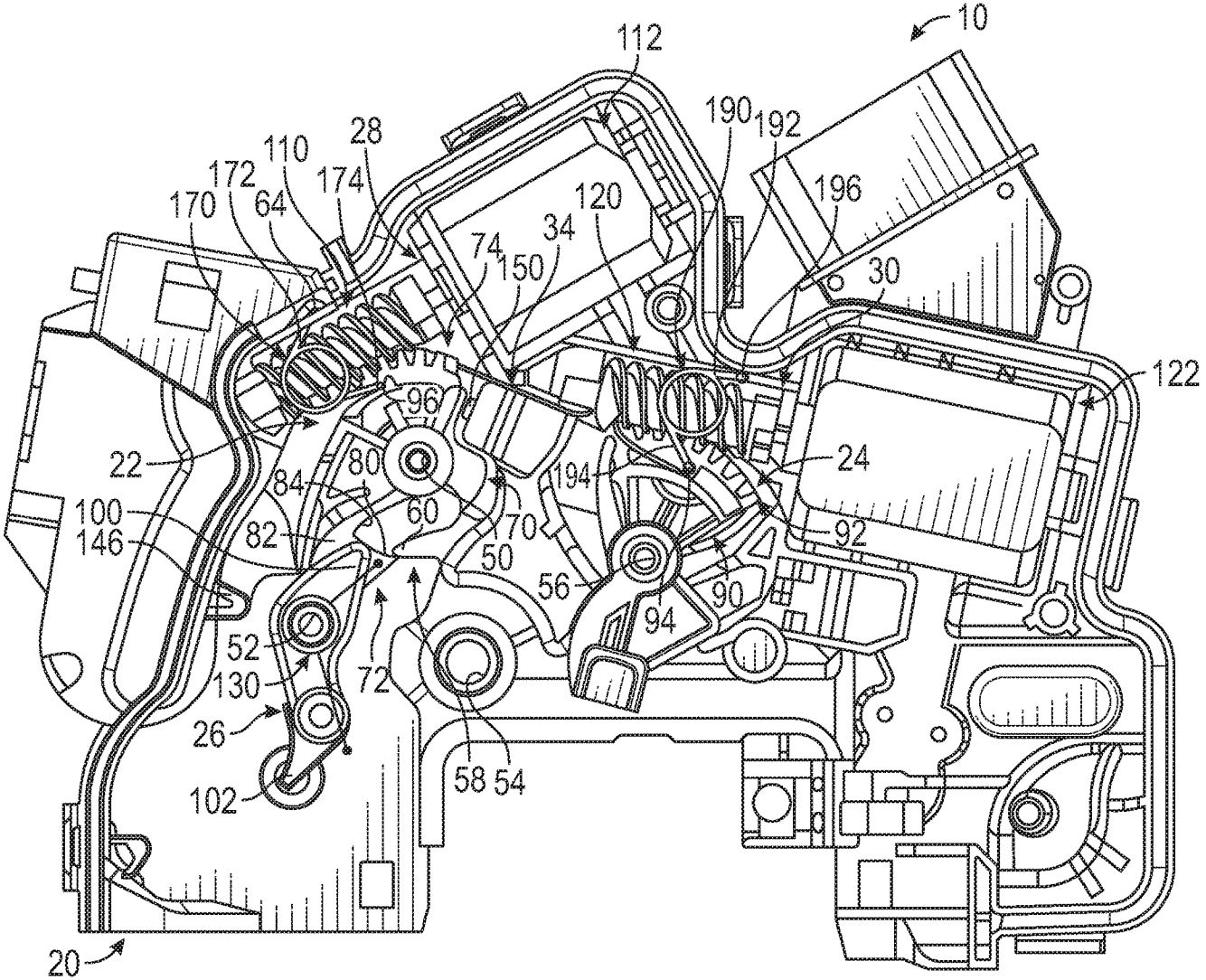
FIG. 1 is a plan view of a door latch assembly having an actuator cover and levers removed.
Figure 4:
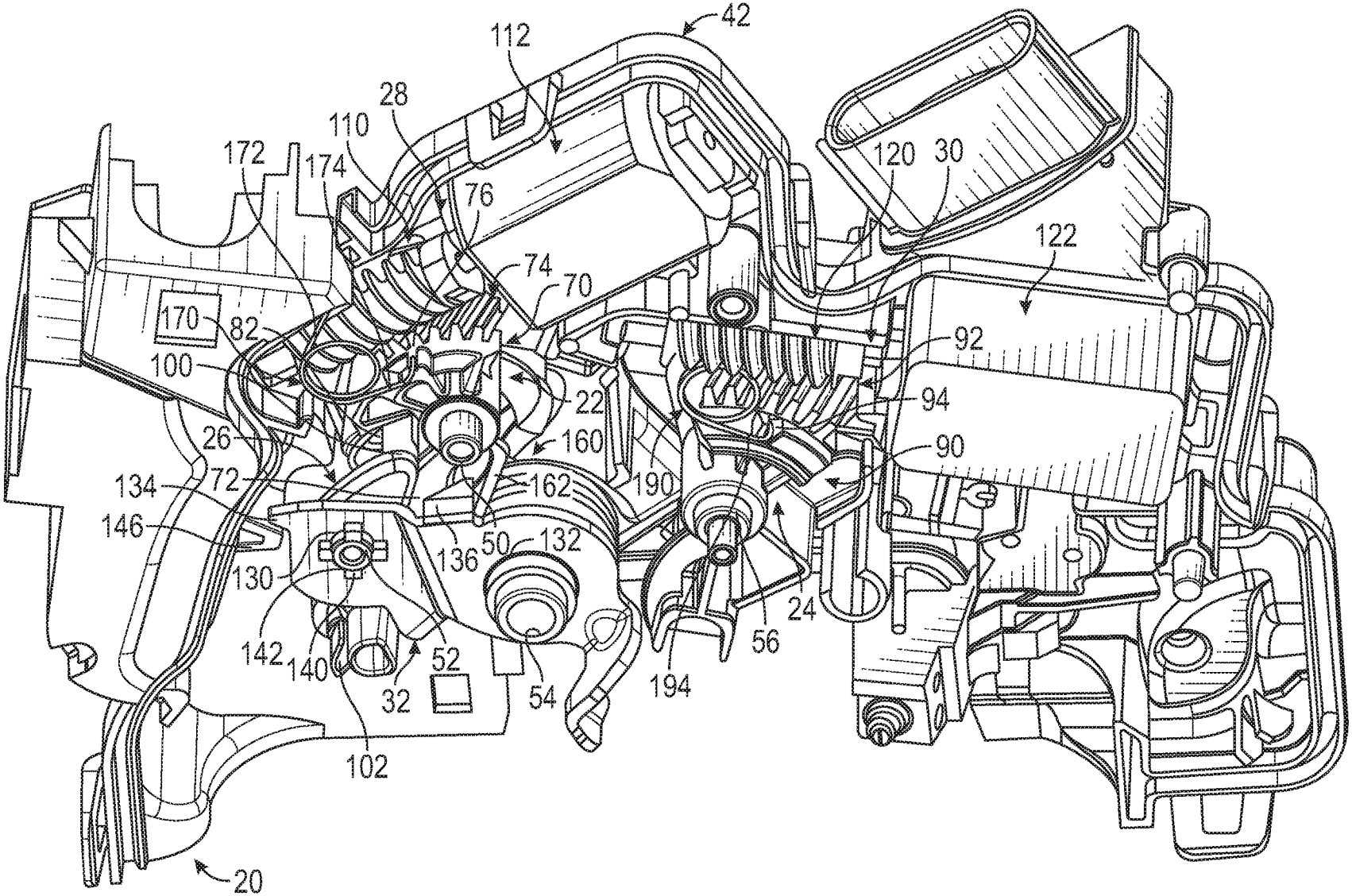
FIG. 4 is a view of the door latch assembly having the cover assembly removed and a lever.

Referring to FIGS. 1 and 4, a door latch assembly 10 is shown. The door latch assembly 10 may be provided with a vehicle, such as a motor vehicle and may be provided with a door assembly, such as a rear door assembly. The door latch assembly 10 may be a powered door latch assembly having features that are electrically powered and operated.

The door latch assembly 10 may be movable between a first position and a second position by an electric motor or the like. The first position may be a position that corresponds to the child lock being at least one of on or off. The second position may be a position that corresponds to the child lock being the other of on or off.

The door latch assembly 10 includes a actuator housing 20, a first sector gear 22, a second sector gear 24, a child link 26, a first motor assembly 28, a second motor assembly 30, a first inner release lever 32, a plunger assembly 34, and a plurality of biasing members.

The actuator housing 20 may be joined to an actuator cover that is removed for clarity. The actuator housing 20 includes a housing floor 40 and a peripheral wall or side wall 42 that extends from the housing floor 40.

A first post 50, a second post 52, a third post 54, a fourth post 56, and a guide 58 may be provided. The first post 50, the third post 54, the fourth post 56, and the guide 58 may be disposed on or defined by the housing floor 40. The posts are spaced apart from each other and facilitate the pivoting of various components about individual pivot axes defined by the posts. The first sector gear 22 is pivotally mounted for rotation about the first post 50. The child link 26 is arranged to pivot on the first inner release lever 32 and the second post 52 defines a moving pivot on the first inner release lever 32. A biasing member, such as an inner release spring, may be disposed about the third post 54 to provide a rotation pivot for the first inner release lever 32. The second sector gear 24 is pivotally mounted for rotation about the fourth post 56.

Figure 3:
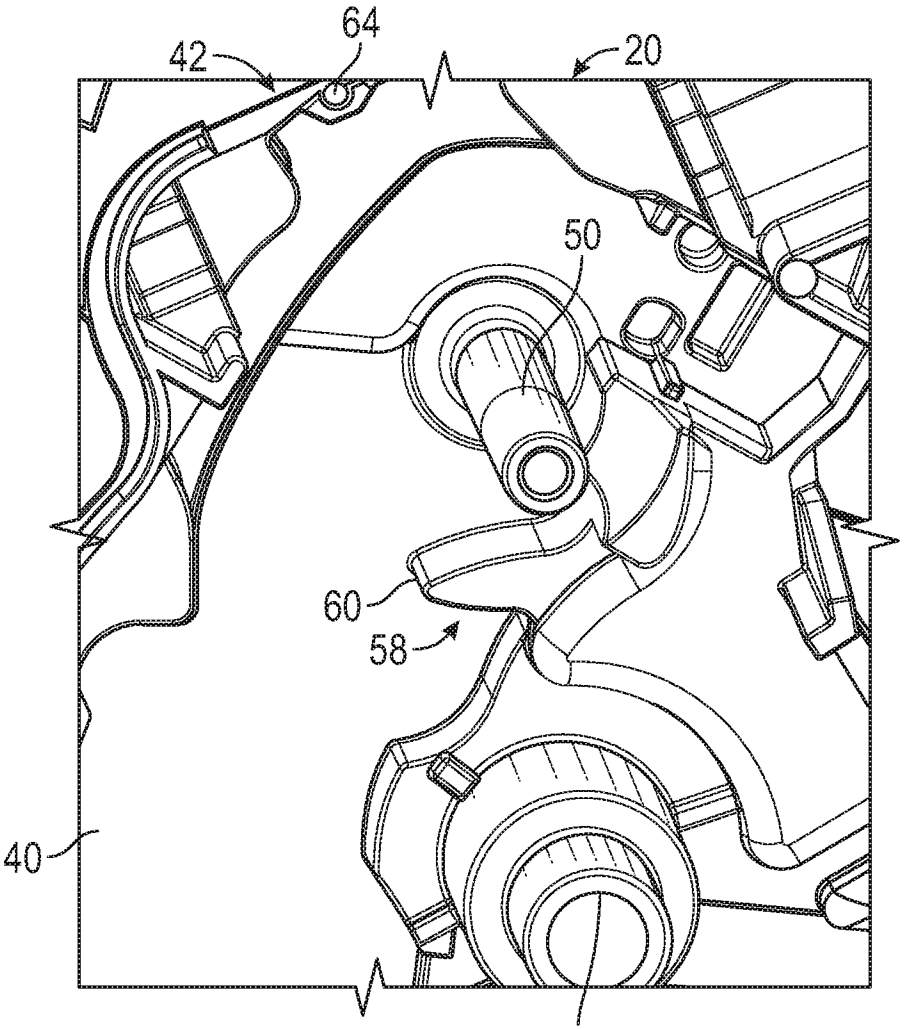
FIG. 3 is a partial view of an actuator housing of the door latch assembly.
Figure 2:
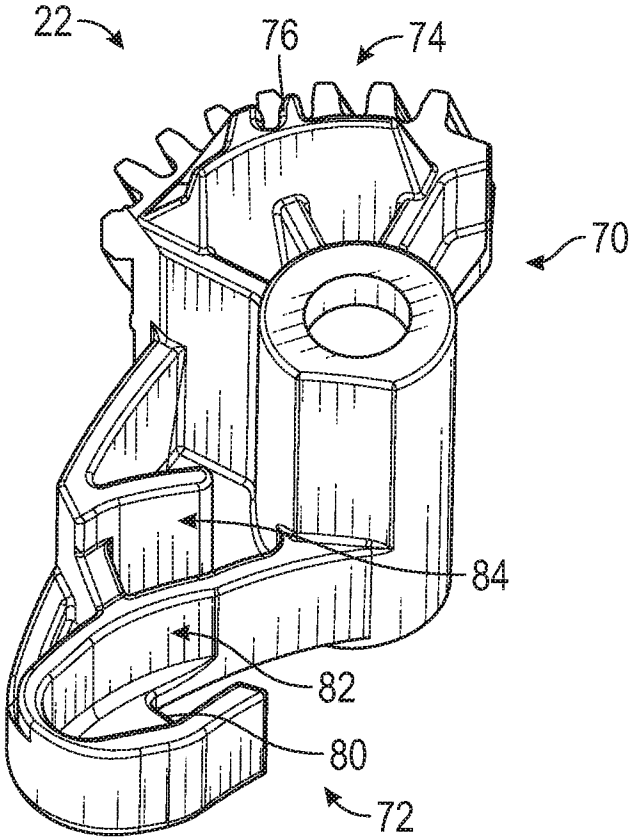
FIG. 2 is a view of a sector gear of the door latch assembly.

As shown in FIGS. 1 and 3, the guide 58 is disposed adjacent to or proximate the first post 50. The guide 58 is disposed between the first post 50 and the third post 54. The guide 58 may be a raised protuberance or a finger having a tip 60 that extends towards the side wall 42.

The side wall 42 defines a mounting feature 64. As shown in FIG. 3, the mounting feature 64 is disposed proximate the first post 50. As arranged, the first post 50 is disposed between the mounting feature 64 and the guide 58.

Figure 5:
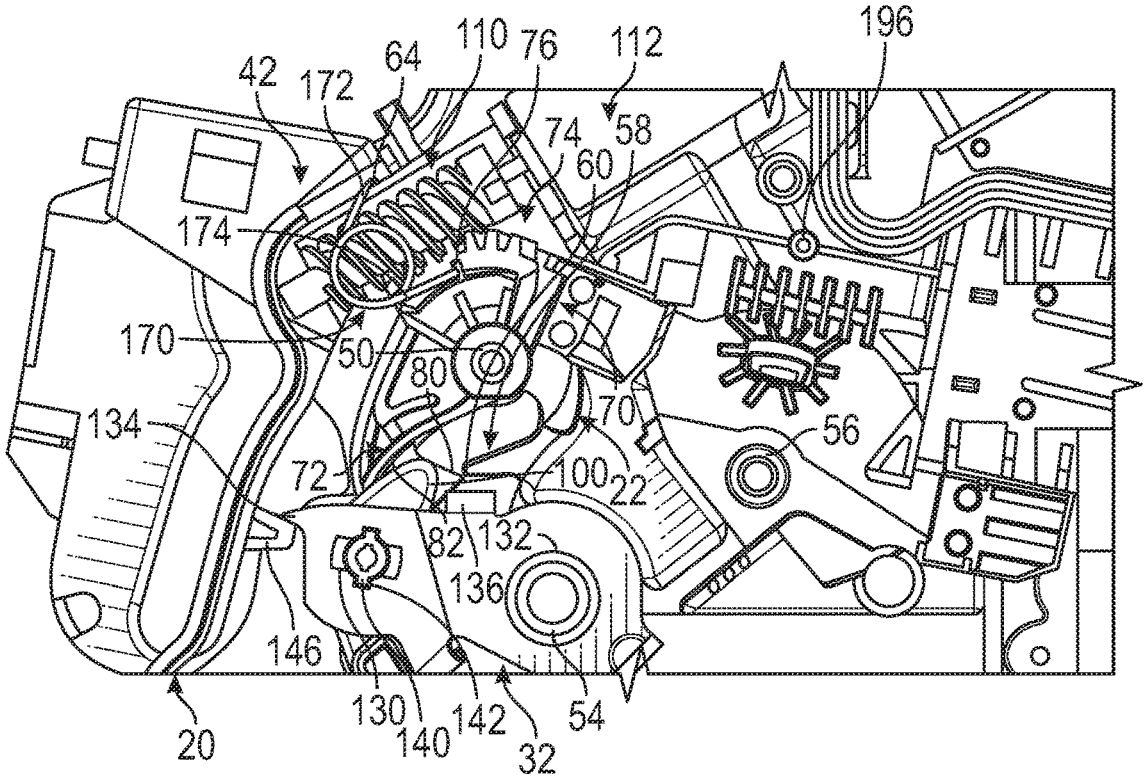
FIG. 5 is a view of the door latch assembly in a first position.
Figure 6:
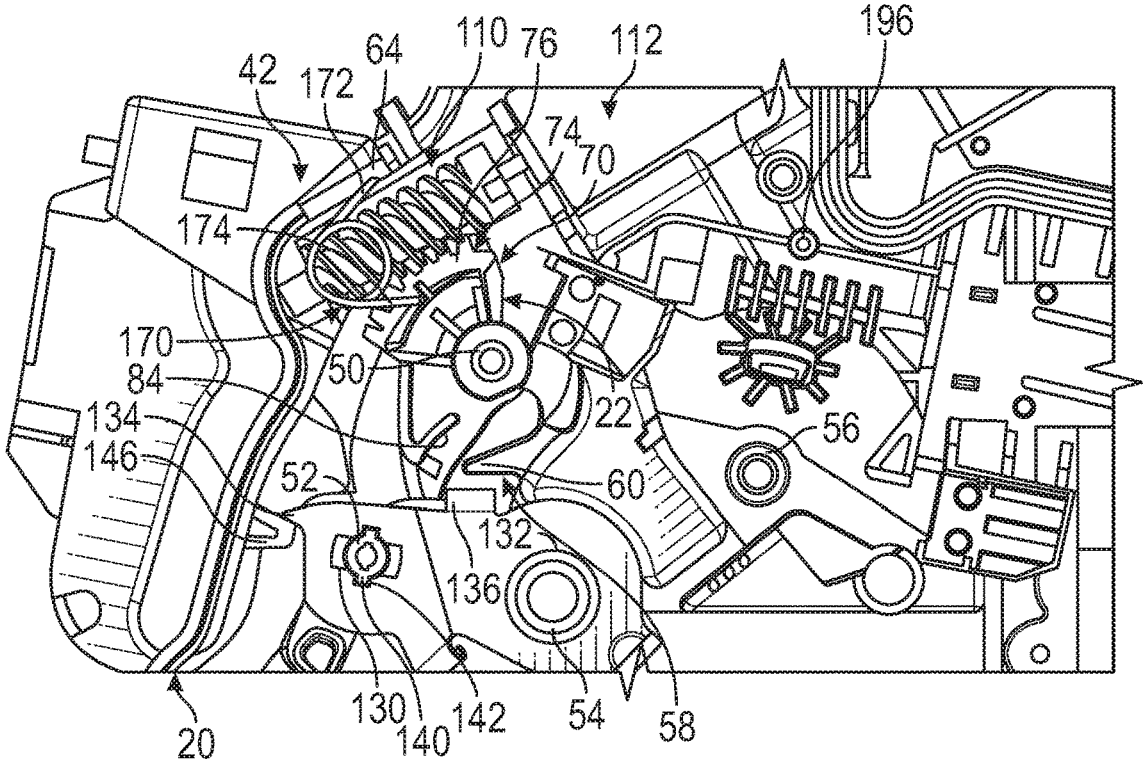
FIG. 6 is a view of the door latch assembly in a second position.

Referring to FIGS. 1, 2, and 4-6, the first sector gear 22 is disposed about the first post 50. The first sector gear 22 is movable or pivotable between a first sector gear position (as shown in FIGS. 1 and 4) and a second sector gear position (as shown in FIG. 6). The first sector gear 22 has a first head 70 and a first arm 72 that extends from the first head 70. The first head 70 defines a first set of teeth 74 and a first opening 76. The first opening 76 is disposed between the first set of teeth 74 and the first arm 72.

The first arm 72 extends away from the first head 70. A distal end of the first arm 72 defines a guide surface 80, an operating surface 82, and a blocking feature 84. The guide surface 80 is spaced apart from the operating surface 82. The guide surface 80 may be at least partially circumscribed or surrounded by the operating surface 82. The guide surface 80 selectively engages the tip 60 of the guide 58. The guide 58 is spaced apart from the guide surface 80 while the first sector gear 22 is in the first sector gear position, as shown in FIGS. 1 and 5. The guide 58 engages the guide surface 80 while the first sector gear 22 is in the second sector gear position, as shown in FIG. 6.

The operating surface 82 may be a generally arcuate surface that is at least partially recessed into the first arm 72. The blocking feature 84 is spaced apart from and offset from the operating surface 82. The blocking feature 84 is disposed generally parallel to but not coplanar with a portion of the operating surface 82.

Referring to FIGS. 1 and 4, the second sector gear 24 is disposed about the fourth post 56. The second sector gear 24 is movable or pivotable between a second sector gear first position and a second sector gear second position. The second sector gear 24 has a second head 90 that defines a second set of teeth 92 and a second opening 94 disposed proximate the second set of teeth 92.

The second post 52 extends through the child link 26. The child link 26 is arranged to pivot on or about the second post 52 of the first inner release lever 32. The child link 26 has a first child link end 100 and a second child link end 102. The first child link end 100 engages the first arm 72 of the first sector gear 22. At least a portion of the first child link end 100 engages the operating surface 82. The second child link end 102 is disposed opposite the first child link end 100.

The first motor assembly 28 includes a first drive member 110 that extends from a first actuator 112. The first drive member 110 is drivably engaged with the first set of teeth 74 of the first head 70 of the first sector gear 22. The rotation or actuation of the first drive member 110 responsive to actuation of the first actuator 112 causes the first sector gear 22 to pivot about the first post 50 between the first sector gear position, as shown in FIG. 5, and the second sector gear position, as shown in FIG. 6. The movement of the first sector gear 22 between the first sector gear position and the second sector gear position causes the first child link end 100 to ride along the operating surface 82 to pivot the child link 26 about the second post 52 between a first child link position, as shown in FIG. 5, and a second child link position, as shown in FIG. 6.

The second motor assembly 30 includes a second drive member 120 that extends from a second actuator 122. The second drive member 120 is drivably engaged with the second set of teeth 92 of the second head 90 of the second sector gear 24. The rotation or actuation of the second drive member 120, responsive to actuation of the second actuator 122, causes the second sector gear 24 to pivot about the fourth post 56 between the second sector gear first position and the second sector gear second position.

Referring to FIGS. 4-6, the first inner release lever 32 is at least partially disposed about or defines the second post 52. The first inner release lever 32 extends between the second post 52 and the third post 54. The first inner release lever 32 defines a first lever opening 130, a second lever opening 132, a first tab 134, and a second tab 136.

The second post 52 extends through the first lever opening 130. In at least one embodiment, the second post 52 includes a retaining member 140 that extends into a slot 142 that extends from the first lever opening 130 and into the first inner release lever 32. The third post 54 extends through the second lever opening 132.

The first tab 134 extends from a proximal end of the first inner release lever 32. The first tab 134 is disposed proximate and may engage a housing feature 146 that extends from the side wall 42, as shown in FIGS. 1 and 4-6.

The second tab 136 extends from the first inner release lever 32 and is disposed between the first lever opening 130 and the second lever opening 132. The second tab 136 may engage with a biasing member and the first inner release lever 32 to return to a rest or first position after a release operation.

Referring to FIG. 1, the plunger assembly 34 is disposed on the housing floor 40. The plunger assembly 34 is disposed between the first sector gear 22 and the second sector gear 24. The plunger assembly 34 includes a plunger 150 that engages the first head 70 of the first sector gear 22 and is spaced apart from the first set of teeth 74. The plunger 150 biases the first head 70 of the first sector gear 22 in a first direction (e.g. the child lock off position).

Referring to FIG. 4, an inner release spring 160 is disposed about the third post 54. The inner release spring 160 may return the first inner release lever 32 to a rest position. The inner release spring may have an arm 162 that engages the second tab 136. The inner release spring 160 is arranged to maintain relative positions of the first inner release lever 32 and the child link 26.

Referring to FIGS. 1 and 4, a first spring 170 extends across the first drive member 110. The first spring 170 may be a first adjustment spring or a first balance adjustment spring. The first spring 170 has a first spring first arm 172 that engages and is operatively connected to the mounting feature 64 and has a first spring second arm 174 that engages and is operatively connected to the first opening 76 of the first sector gear 22. The first sector gear 22 is movable between a first sector gear first position and a first sector gear second position. The first spring 170 is arranged to make the first sector gear 22 robust against vibration, inertia, impacts, or the like. The first spring first arm 172 and the first spring second arm 174 of the first spring 170 is arranged to bias the first head 70 of the first sector gear 22 in a second direction that is disposed opposite the first direction.

Referring to FIG. 1, a biasing member 180 is disposed about the second post 52. The biasing member 180 has a first biasing member arm 182 and a second biasing member arm 184. The first biasing member arm 182 may be disposed between and engage the first child link end 100 and the distal end of the first arm 72. The second biasing member arm 184 is disposed proximate and may engage the second child link end 102. The biasing member 180 is arranged to bias the child link 26 and the first sector gear 22 towards the child lock off position.

Referring to FIGS. 1 and 4, a second spring 190 extends across the second drive member 120. The second spring 190 may be a second adjustment spring or a second balance adjustment spring. The second spring 190 has a second spring first arm 192 and a second spring second arm 194. The second spring first arm 192 engages and is operatively connected to an opening 196 that may be defined by at least one of the housing floor 40 or the side wall 42. The second spring second arm 194 engages and is operatively connected to the second opening 94. The second sector gear 24 is movable between a second sector gear first position and a second sector gear second position. The second spring 190 is arranged to make the second sector gear 24 robust against vibration, inertia, impacts, or the like. The second spring first arm 192 and the second spring second arm 194 is arranged to bias the second head 90 of the second sector gear 24 in a second direction that is disposed opposite the first direction.

The provision of the biasing members or springs (e.g. 160, 170, 180, and 190) may balance as well as adjust the forces within the door latch assembly 10 to inhibit jamming of the door latch assembly 10.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in scope with the present disclosure. Additionally, while various embodiments of the present disclosure have been described, it is to be understood that aspects of the present disclosure may include only some of the described embodiments or combinations of the various embodiments. Accordingly, the present disclosure is not to be seen as limited by the foregoing description.

Having thus described the present disclosure, it is claimed:

1. A door latch assembly, comprising:

an actuator housing having a housing floor and a side wall extending therefrom;

a first post disposed on the housing floor;

a first sector gear pivotally mounted for rotation about the first post, the first sector gear having a first head defining a first set of teeth and a first arm extending from the first head;

a first inner release lever that at least partially defines a second post, the first inner release lever and the second post define a moving pivot on the first inner release lever;

a first spring having a first spring first arm that is operatively connected to the side wall and a first spring second arm that is operatively connected to the first head;

a child link pivotally mounted for rotation about the second post, the child link having a first child link end connected to the first arm and a second child link end; and a first motor assembly having a first drive member engaged with the first set of teeth, the first motor assembly being arranged to pivot the first sector gear about the first post, between a first sector gear position and a second sector gear position, such that the child link pivots about the second post between a first child link position and a second child link position.

2. The door latch assembly of claim 1, wherein a distal end of the first arm defines an operating surface.

3. The door latch assembly of claim 2, wherein at least a portion of the first child link end engages the operating surface.

4. The door latch assembly of claim 2, wherein the distal end defines a guide surface spaced apart from the operating surface.

5. The door latch assembly of claim 4, wherein the housing floor defines a guide that is disposed adjacent the first post.

6. The door latch assembly of claim 5, wherein the guide is spaced apart from the guide surface while the first sector gear is in the first sector gear position.

7. The door latch assembly of claim 5, wherein the guide engages the guide surface while the first sector gear is in the second sector gear position.

8. The door latch assembly of claim 1, further comprising a third post disposed on the housing floor.

9. The door latch assembly of claim 8, wherein the first inner release lever extends between the second post and the third post.

10. A door latch assembly, comprising:

an actuator housing having a housing floor and a side wall extending from the housing floor, the housing floor defining a guide and the side wall defining a mounting feature;

a first post and a third post disposed on the housing floor;

a first sector gear pivotally mounted for rotation about the first post, the first sector gear having a first head defining a first set of teeth and a first arm having a distal end that defines a guide surface that selectively engages the guide;

a child link pivotally mounted for rotation about a second post defined by a first inner release lever, the first inner release lever and the second post define a moving pivot on the first inner release lever, the child link having a first child link end and a second child link end; and an inner release spring disposed about the third post and having an arm that engages the first head.

11. The door latch assembly of claim 10, wherein the inner release spring is arranged to maintain relative positions of the first inner release lever and the child link.

12. The door latch assembly of claim 10, wherein the first arm defines an operating surface that is spaced apart from the guide surface and engages the first child link end.

13. The door latch assembly of claim 10, further comprising:

a first spring having a first spring first arm that is operatively connected to the mounting feature and a first spring second arm that is operatively connected to the first head.

14. The door latch assembly of claim 13, further comprising:

a first motor assembly having a first drive member engaged with the first set of teeth, the first motor assembly being arranged to pivot the first sector gear about the first post.

15. The door latch assembly of claim 14, wherein the first spring extends across the first drive member.

16. The door latch assembly of claim 10, wherein the second post extends through the child link.

17. The door latch assembly of claim 16, further comprising:

a biasing member disposed about the second post, the biasing member having a first biasing member arm that engages the first child link end.

18. The door latch assembly of claim 10, further comprising:

a plunger assembly disposed on the housing floor, the plunger assembly having a plunger that engages the first head.

19. The door latch assembly of claim 18, wherein the plunger biases the first head in a first direction and the arm biases the first head in a second direction disposed opposite the first direction.

* * * * *